United States Patent [19]

Brackmann

[11] Patent Number: 5,074,603

[45] Date of Patent: Dec. 24, 1991

[54] MOTOR-VEHICLE DOOR LATCH WITH POSITION HOLD

[75] Inventor: Horst Brackmann, Velbert, Fed. Rep. of Germany

[73] Assignee: Kiekert GmbH & Co. KG, Heiligenhaus, Fed. Rep. of Germany

[21] Appl. No.: 632,374

[22] Filed: Dec. 21, 1990

[30] Foreign Application Priority Data

Jul. 25, 1990 [DE] Fed. Rep. of Germany ..... 4023560
Oct. 19, 1990 [DE] Fed. Rep. of Germany ..... 4033271

[51] Int. Cl.[5] ..... E05C 3/26

[52] U.S. Cl. ..... 292/216; 292/DIG. 43; 292/DIG. 65; 292/201

[58] Field of Search ..... 292/216, 280, 201, DIG. 43, 292/DIG. 65

[56] References Cited

U.S. PATENT DOCUMENTS 3,378,291 4/1968 Brian ..... 292/DIG. 43 X
4,157,844 6/1979 Sarosy et al. ..... 292/DIG. 43 X
4,906,035 3/1990 Nogai et al. ..... 292/DIG. 43 X

*Primary Examiner*—Richard E. Moore

*Attorney, Agent, or Firm*—Herbert Dubno; Andrew Wilford

[57] ABSTRACT

A motor-vehicle door latch for securing together two relatively movable body parts has a housing mounted on one of the parts, a bolt mounted on the other part and engageable in the housing, a fork pivotal in the housing between a locked position engaging around the bolt when therein and an unlocked position permitting the bolt to enter and exit the housing, a pawl pivotal in the housing between a holding position retaining the fork in the locked position and a freeing position permitting the fork to move between its positions, and an actuating lever engageable with the pawl and pivotal in the housing between a holding position holding the pawl in its freeing position and a freeing position in which it does not impede movement of the pawl between its position. A position-holding element engageable in the housing with the lever is movable between a blocking position preventing movement of the lever of the freeing position and an unblocking position permitting movement of the lever between its positions. This element is linked to the fork for putting the element in the unblocking position only when the fork is in the open position.

6 Claims, 8 Drawing Sheets

MOTOR-VEHICLE DOOR LATCH WITH POSITION HOLD

FIELD OF THE INVENTION

The present invention relates to a motor-vehicle door latch. More particularly this invention concerns such a latch used on the trunk or hatch and set up to hold in the open position until all parts actually move into this position.

BACKGROUND OF THE INVENTION

A standard motor-vehicle door latch specifically intended for use on a trunk like or rear hatch has a standard latch housing, a latch fork pivotal on the housing and latchingly engageable around a latch element, a latch pawl mounted on the housing for retaining the fork around the element or releasing it to free the element, and an operating lever which actuates the latch pawl. This pawl can be moved into the fork-freeing position by a manual actuator and/or by an electric actuator. The housing is typically mounted on the edge of a side door, but when used for the trunk or hatch is mounted on the edge of the opening in which the trunk or hatch fits.

A common problem with such a latch, in particular when used on a trunk lid or the like, is that even when the pawl has been actuated to free the bolt, the lid does not open, for instance because it is frozen shut. This is a fairly hazardous situation since it is then possible for the trunk lid or hatch to open at a later time, for instance when the vehicle is under way.

A solution to this problem is posed by German patent 3,406,116 filed 21 Feb. 1984 by Horst Brackmann. Here a force-storing element holds the operating lever in the release or actuated position until the fork moves into the open position. Thus if the lid stays closed, all the parts except the fork remain in the open position. The significance of this is that the latch is typically provided with a switch connected to a dashboard light that indicates the on/off condition of the trunk lid. In this arrangement the switch is actuated by the fork-operating mechanism, not by the fork, so that in this potentially dangerous situation the driver will be able to know that while the trunk or other door appears latched, in reality it is not.

In this earlier arrangement a separate rotary cam is provided for electric actuation of the latch. This cam is an essential part of the position-holding structure and without it the position-holding system cannot work. Indeed, the position-holding arrangement cannot be applied to a purely manual system.

OBJECTS OF THE INVENTION

It is therefore an object of the present invention to provide an improved motor-vehicle door latch with a position-holding system.

Another object is the provision of such an improved motor-vehicle door latch with a position-holding system which overcomes the above-given disadvantages, that is which is of simple and reliable construction but that also can be applied to purely manual door latches.

SUMMARY OF THE INVENTION

A motor-vehicle door latch for securing together two relatively movable body parts has a housing mounted on one of the parts, a bolt mounted on the other part and engageable in the housing, a fork pivotal in the housing between a locked position engaging around the bolt when therein and an unlocked position permitting the bolt to enter and exit the housing, a pawl pivotal in the housing between a holding position retaining the fork in the locked position and a freeing position permitting the fork to move between its positions, and an actuating lever engageable with the pawl and pivotal in the housing between a holding position holding the pawl in its freeing position and a freeing position in which it does not impede movement of the pawl between its positions. According to the invention a position-holding element engageable in the housing with the lever is movable between a blocking position preventing movement of the lever out of the freeing position and an unblocking position permitting movement of the lever between its positions. This element is linked to the fork for putting the element in the unblocking position only when the fork is in the open position.

Thus with the system of this invention the actuating lever is held in the freeing position until the fork moves into the open position. This arrangement works equally well with a latch that is operated either wholly manually, as for instance by a bowden-cable release having a handle in the passenger compartment, or by a motor as part of an electric lock system.

According to another feature of this invention a spring urges the position-holding element into the blocking position and the position-holding element is formed with a shoulder engageable against the actuating lever in the blocking position. Furthermore the element also holds the pawl in its freeing position when the element is in the blocking position.

The latch also has in accordance with this invention a switching lever in the housing displaceable by the element between a door-open position corresponding to the blocking position of the element and a door-closed position corresponding to the unblocking position of the element. A switch actuatable by the switching lever in at least one of its positions can provide a signal to the driver that the latch has been unlocked, even if the door in question has not visibly opened.

The link between the fork and the position-holding element according to this invention includes a cam surface on the element and a pin engageable with the surface and carried on the fork.

BRIEF DESCRIPTION OF THE DRAWING

The above and other objects, features, and advantages will become more readily apparent from the following, reference being made to the accompanying drawing in which.

SPECIFIC DESCRIPTION

As seen in FIGS. 1 through 4 and 8 the latch according to this invention has a housing 1 normally fixed to a door or vehicle-body part indicated schematically at P and formed with a cutout in which can engage a bolt B that is carried on the other vehicle part or door. Typically in a trunk-lid system the bolt B is carried on the door while the housing 1 is mounted on the vehicle frame, although of course the opposite arrangement is possible.

Figure 1:
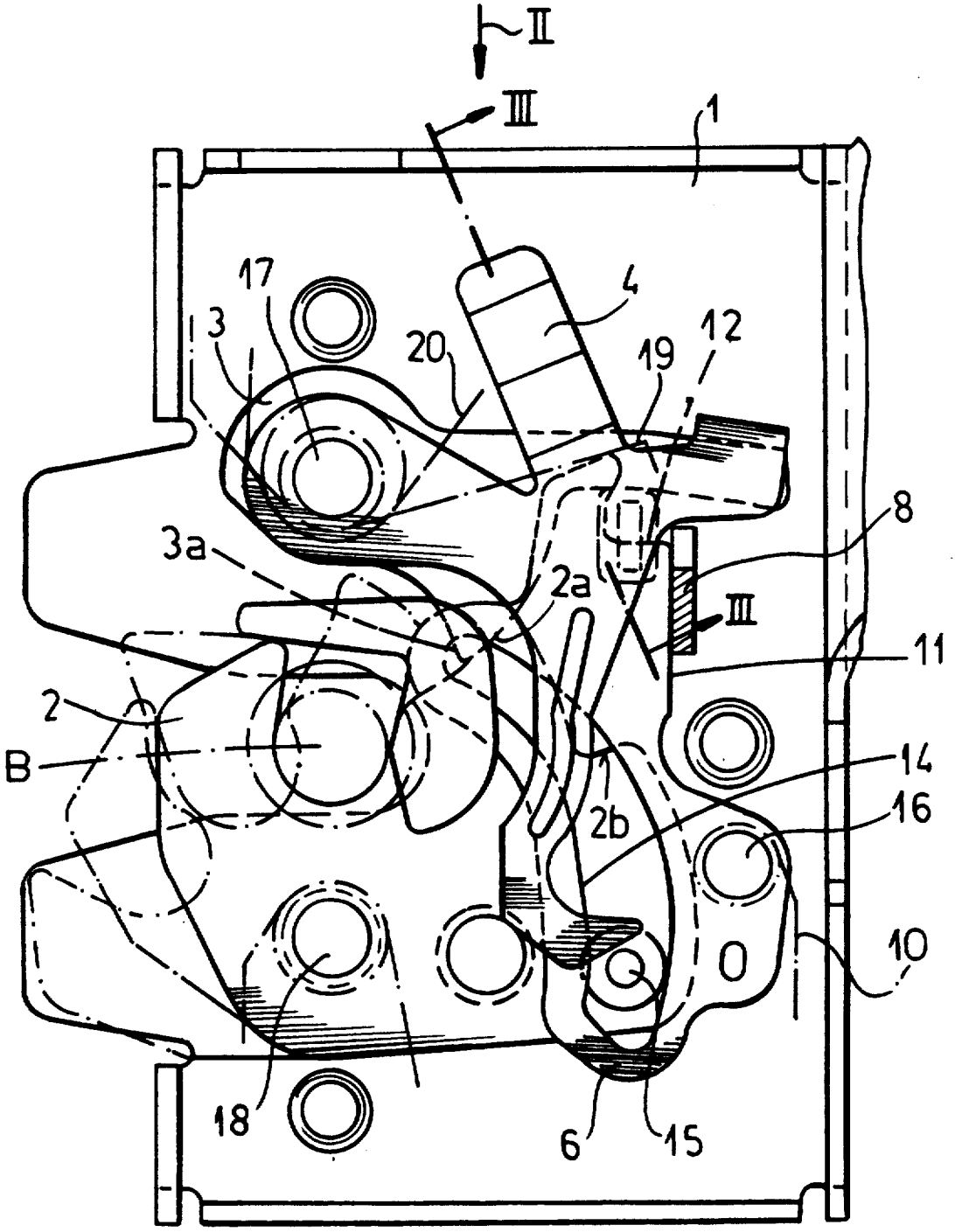
FIG. 1 is a partly sectional side view of the latch according to this invention in the closed position.
Figure 2:
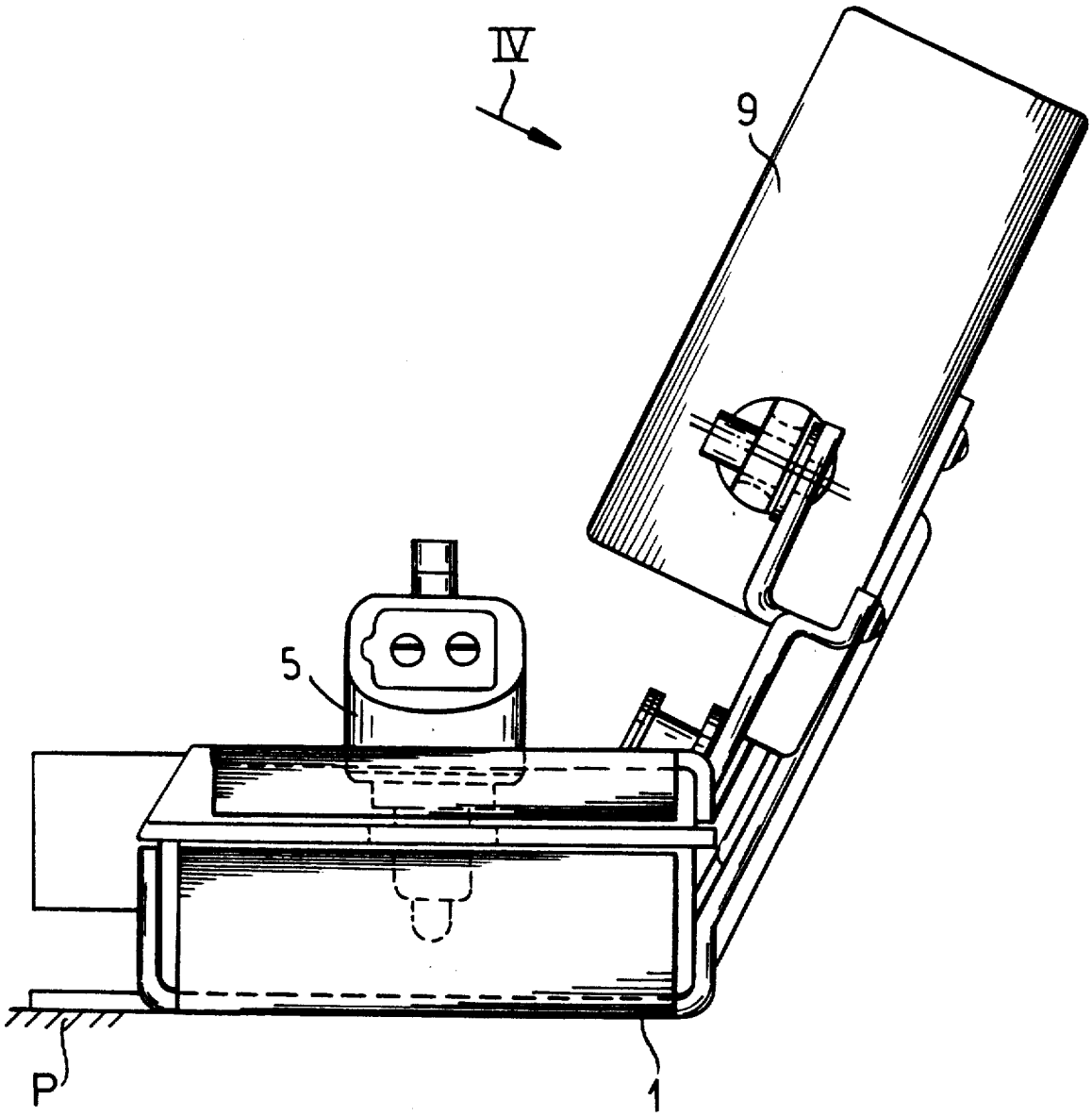
FIG. 2 is a view taken in the direction of arrow II of FIG. 1.
Figure 3:
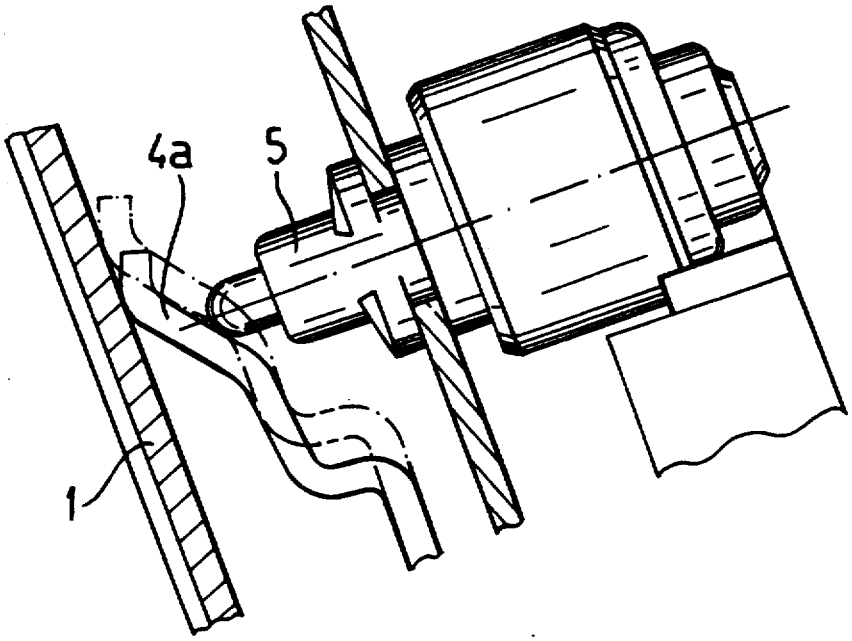
FIG. 3 is a section taken along line III—III of FIG.
Figure 5:
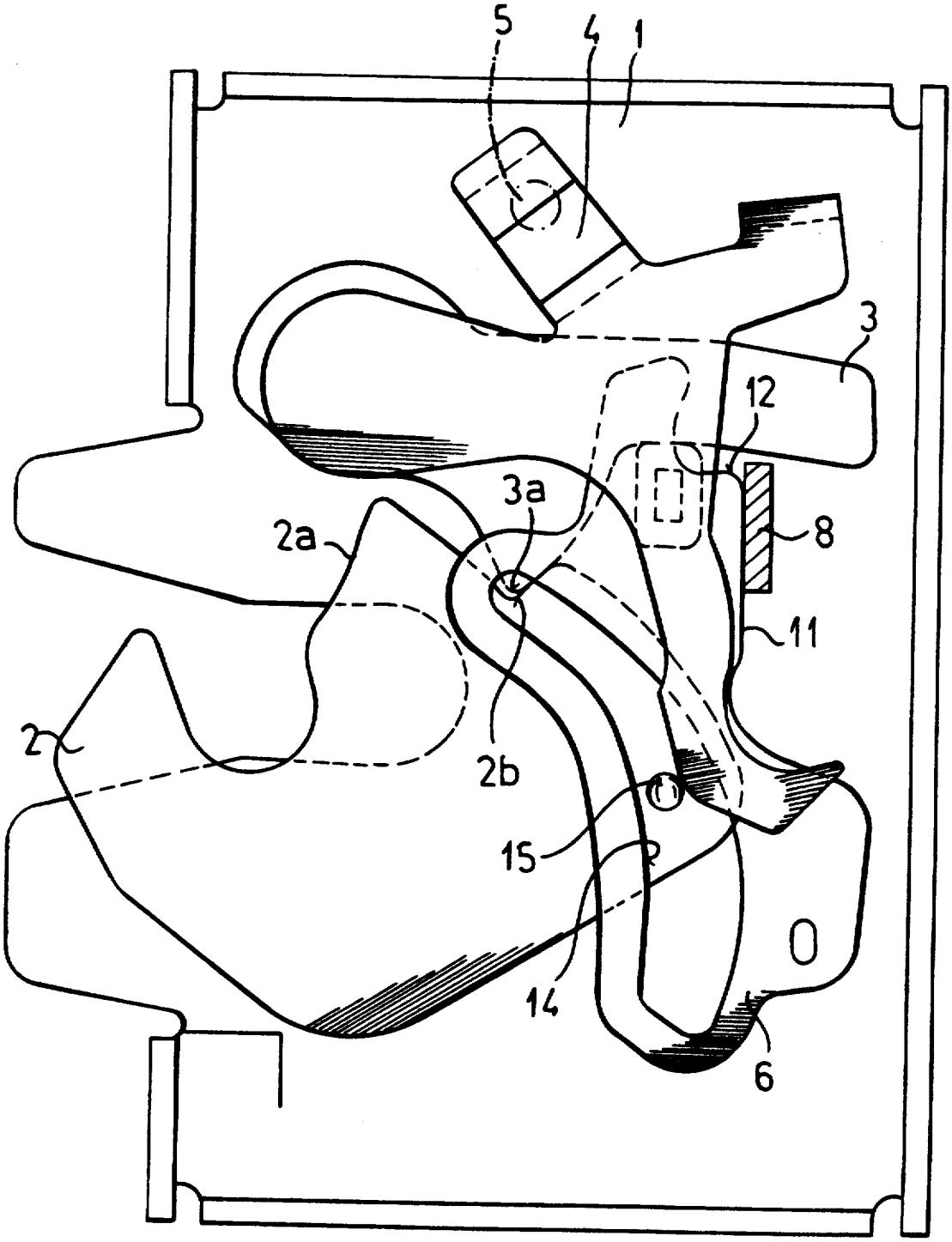
FIGS. 5, 6, and 7 are simplified views showing the latch in the partially closed, open, and unlatched but still closed positions, respectively.

The housing 1 contains a standard locking fork 2 provided with two retaining steps 2*a* and 2*b* that can be engaged by a nose 3*a* of a locking pawl 3 to hold it, as is standard, in a partially locked or a fully locked position shown respectively in FIGS. 5 and 1. The pawl 3 itself operates a three-armed switching lever 4 having one arm 4*a* that can act as shown in FIG. 3 on a switch 5 that provides a remote indication for the position of the lock mechanism, another arm 4*b* engageable with an extension 3*b* of the pawl 3, and a third arm 4*c* whose function is described below. A spring 19 urges the lever 4 clockwise as seen in FIG. 1 and another spring 20 similarly urges the pawl 3 clockwise also.

Figure 4:
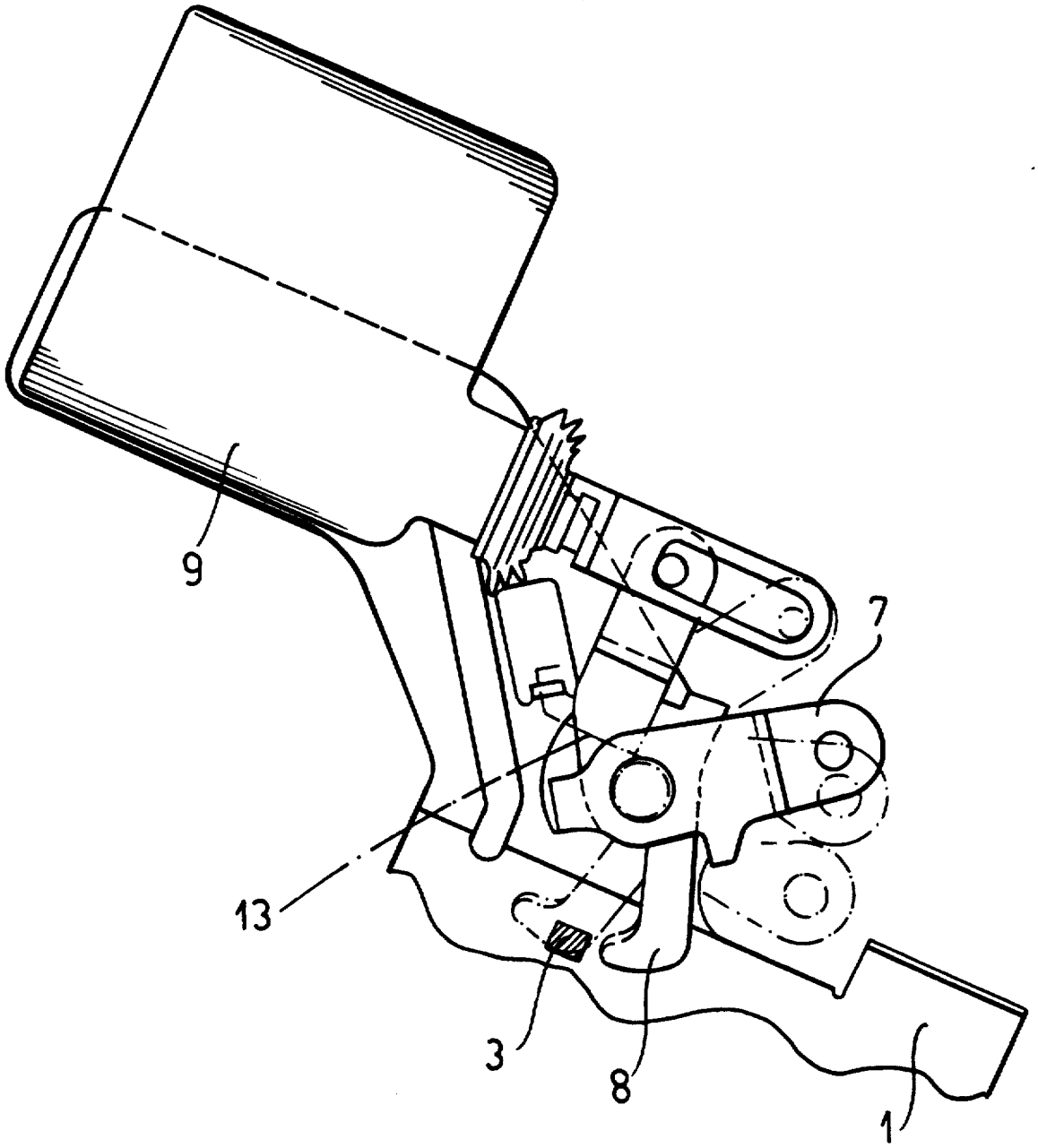
FIG. 4 is a partly sectional view taken in the direction of arrow IV of FIG. 2.

A position-holding element 6 is pivotal on the housing 1 about an axis 16 parallel to the axis 17 for the pawl 3 and lever 4 and to the axis 18 for the fork 2. This element 6 is urged counterclockwise as seen in FIG. 1 by a spring 10 and has a face 11 that can slide along a main operating element 8 and a notch or shoulder 12 that can engage under this element 8. As shown in FIG. 4 a motor 9 or a remote cable-controlled lever 7 can move the lever 8 which is set to act directly on the arm 3*b* of the pawl 3. A spring 13 (FIG. 4) urges the lever 8 away from the arm 3*b* of the pawl 3, that is down as seen in FIG. 1.

Figure 6:
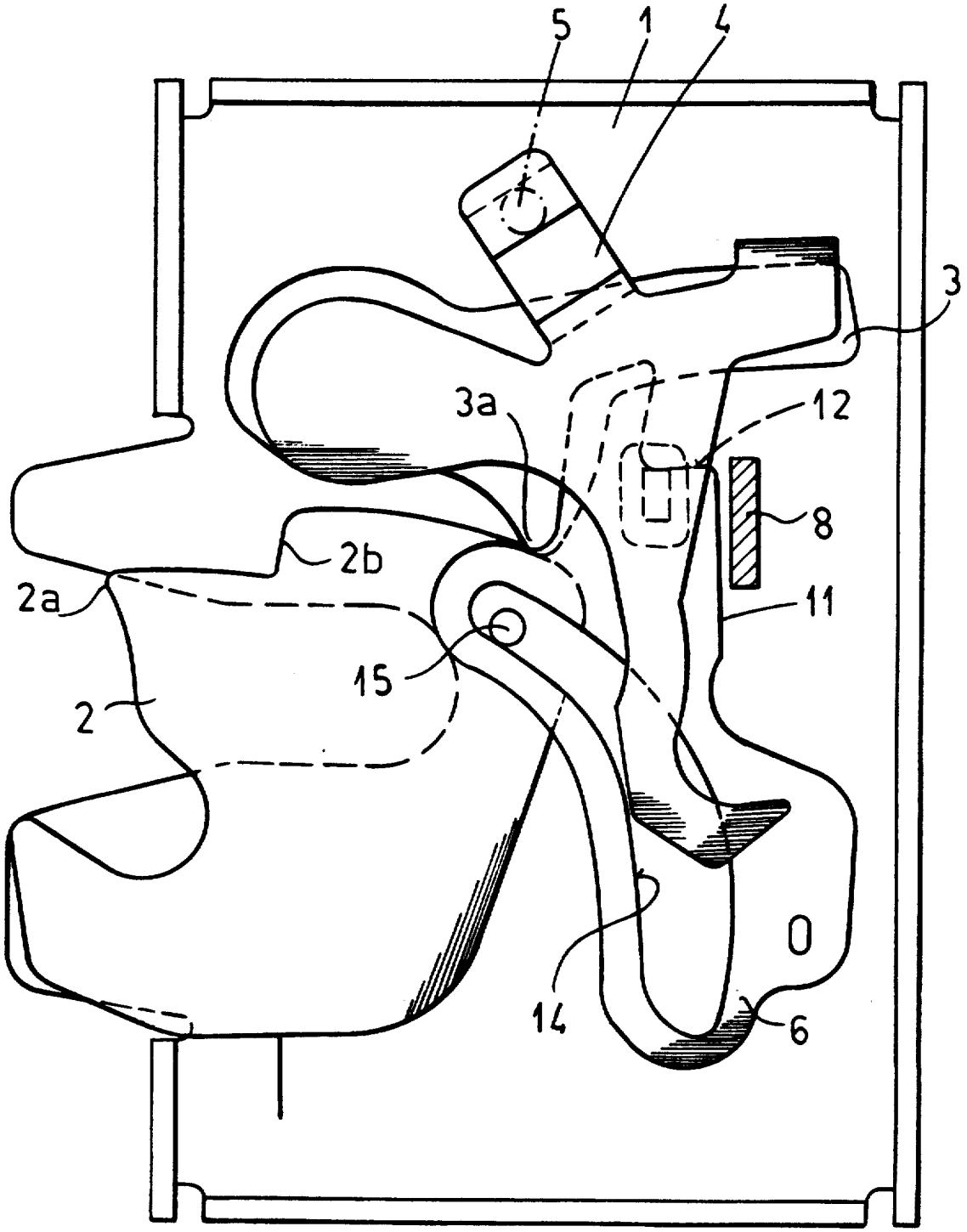
Figure 7:
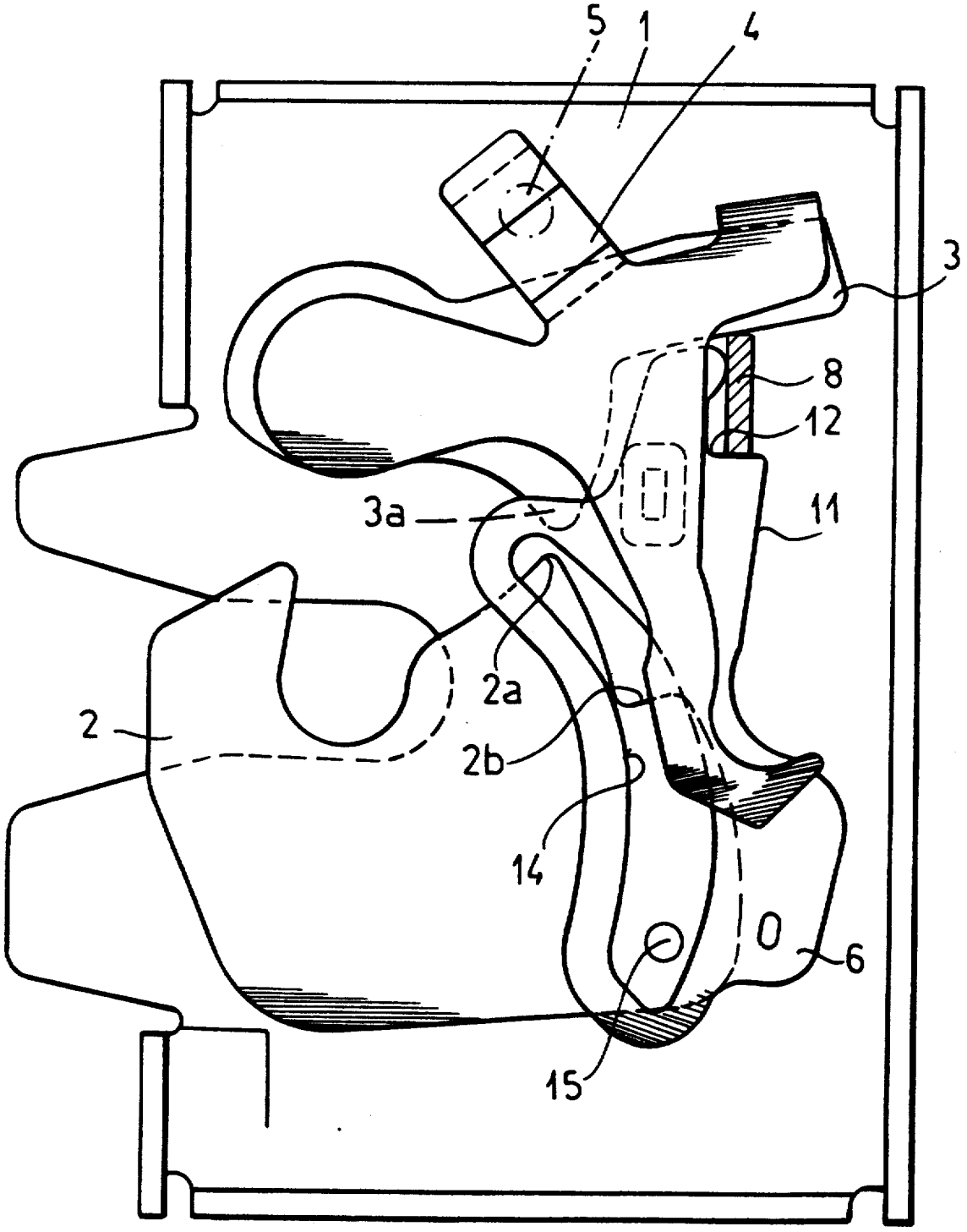
Figure 8:
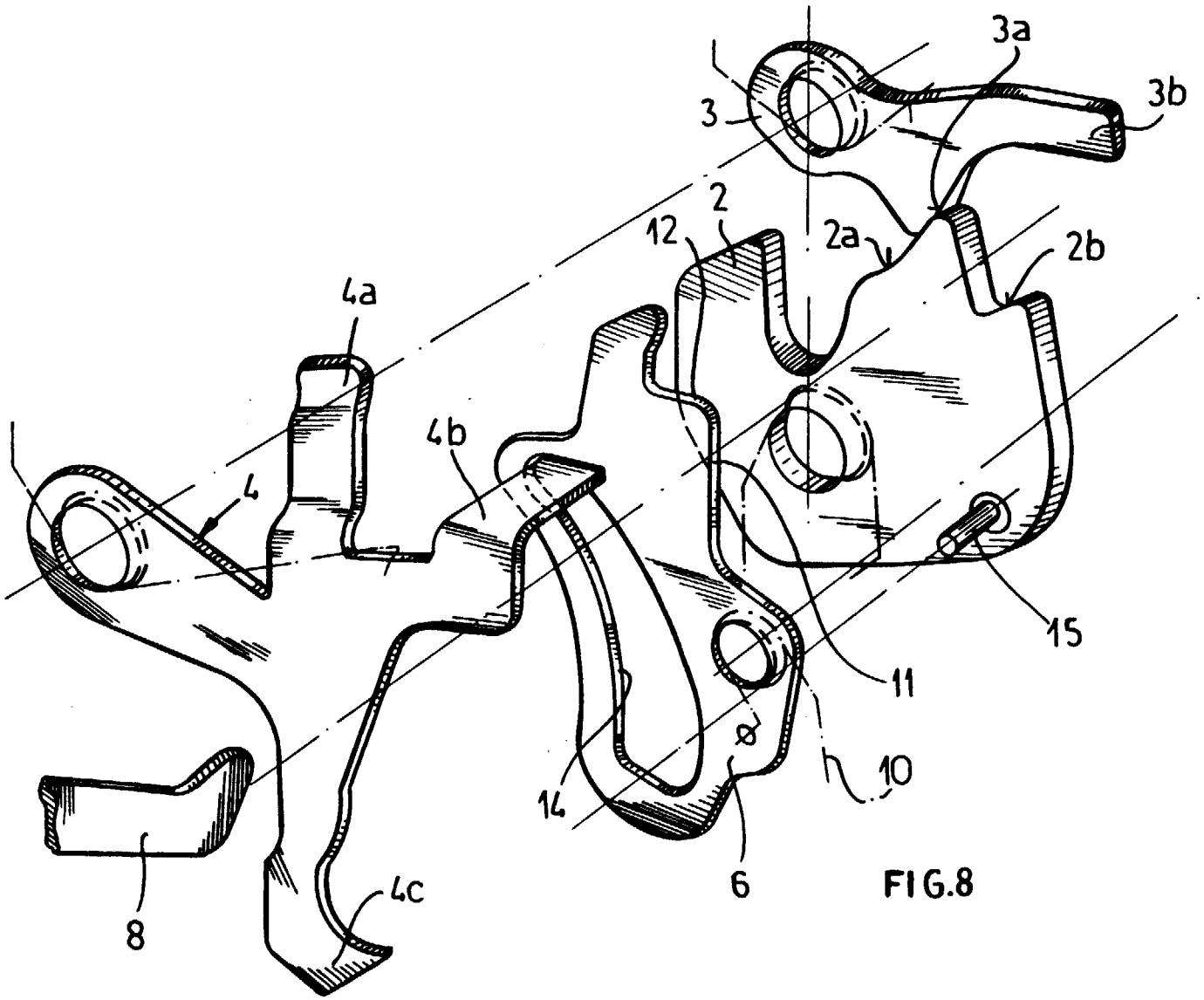
FIG. 8 is an exploded view illustrating the operating levers and elements of the latch of this invention.

The fork 2 is provided with an entrainment pin 15 that can engage in a camming slot 14 of the element 6 to pivot it between blocking and unblocking positions. In the unblocking position seen in FIGS. 1 and 6 the surface 11 of the element 6 is spaced slightly from the lever 8 so that it does not interfere at all with movement of same. In the blocking position as seen in FIG. 7 the element 6 can engage under the lever 8 and hold it and the pawl 3 up in the actuated position they are moved into when the latch is to be opened.

The system described above works as follows:

When normally fully latched as shown in FIG. 1 the nose 3*a* of the pawl 3 engages the step 2*a* of the fork 2 and holds it against counterclockwise rotation in its locked position. In addition the spring 10 presses the surface 11 against the side of the lever 8, but same still can stay in its holding position. The pin 15 is out of contact with the cam surface 14 so that pivoting of the element 8 is not constrained in any manner. In addition the spring 19 holds the switching lever 4 with its arm 4*b* down against the arm 3*b* of the pawl 3 and the end of the arm 4*a* presses the switch 5 all the way in.

To unlatch the door the motor 9 or lever 7 is actuated to lift the lever 8 into the freeing position and therefore engage it with the arm 3*b*, thereby lifting the pawl 3 also into its freeing position to pull its nose 3*a* out of contact with the fork 2, permitting same to rotate counterclockwise into its unlocked position and free the bolt B. As illustrated in FIG. 6 the fork 2 then normally is pivoted into its unlocked position to press its pin 15 against the surface 14 and pivot the element 6 clockwise also, pulling it out of the way of the lever 8 into its unblocking position. Thus once the latch is fully opened, with the fork 2 in the fully open or unlocked position, the lever 8 is free to return to its unactuated or holding position illustrated in FIGS. 1 and 6. Meanwhile the arm 4*a* slides over the switch 5 to give a "door open" signal to the dashboard indicator light since the pawl 3 is held up by its nose 3*a* and holds up the lever 4 by the arm 4*b*.

FIG. 5 illustrates how in a partially open position the nose 3*a* of the pawl 3 engages the second step 2*b* of the fork 2, thereby retaining it. In this position, however, the pin 15 of 20 the fork 2 still engages the arm 4*c* of the lever 4, holding it in the "open door" position so that the appropriate signal will be given, even though the door is partially latched.

If something prevents the door, which term here is intended to also cover a trunk lid or hatch, from opening, the fork 2 will not pivot out as shown in FIG. 7. Thus its pin 15 will not hold back the element 6 so that same will be pivoted by its spring 10 to move its shoulder 12 into the blocking position under the lever 8 as same is raised into the freeing or actuated position. The element 6 will therefore retain the lever 8, pawl 3, and lever 4 all in the actuated or open-door position, even through the fork 2 is still in the locked position. Thus the driver will get a dashboard signal indicating that the door is open, even though it appears closed.

When subsequently the door is forced open, the fork 2 will pivot into the FIG. 6 open position and its pin 15 will pull the element 6 back into the unblocking position out of contact with the lever 8, permitting it and the pawl 3 and lever 4 to snap back into their normal unactuated positions.

I claim:

1. A motor-vehicle door latch for securing together two relatively movable body parts, the latch comprising:

a housing mounted on one of the parts;

a bolt mounted on the other part and engageable in the housing;

a fork pivotal in the housing between a locked position engaging around the bolt when therein and an unlocked position permitting the bolt to enter and exit the housing;

a pawl pivotal in the housing between a holding position retaining the fork in the locked position and a freeing position permitting the fork to move between its positions;

an actuating lever engageable with the pawl and pivotal in the housing between a holding position holding the pawl in its freeing position and a freeing position in which it does not impede movement of the pawl between its positions;

a position-holding element engageable in the housing with the lever and movable between a blocking position preventing movement of the lever out of the freeing position and an unblocking position permitting movement of the lever between its positions; and link means coupling the element to the fork for putting the element in the unblocking position only when the fork is in the open position.

2. The motor-vehicle door latch defined in claim 1, further comprising a spring urging the position-holding element into the blocking position.

3. The motor-vehicle door latch defined in claim 1 wherein the position-holding element is formed with a shoulder engageable against the actuating lever in the blocking position.

4. The motor-vehicle door latch defined in claim 1 wherein the element also holds the pawl in its freeing position when the element is in the blocking position.

5. The motor-vehicle door latch defined in claim 1, further comprising:

a switching lever in the housing displaceable by the element between a door-open position corresponding to the blocking position of the element and a door-closed position corresponding to the unblocking position of the element; and a switch actuatable by the switching lever in at least one of its positions.

6. The motor-vehicle door latch defined in claim 1 wherein the link means includes a cam surface on the element and a pin engageable with the surface and carried on the fork.

* * * * *